US010710839B2

(12) United States Patent
Ruff

(10) Patent No.: US 10,710,839 B2
(45) Date of Patent: Jul. 14, 2020

(54) HIGH EFFICIENCY BOBBIN WINDING DEVICE WITH ADJUSTABILITY

(71) Applicant: Pamela Ruff, Chesapeake, VA (US)

(72) Inventor: Pamela Ruff, Chesapeake, VA (US)

( * ) Notice: Subject to any disclaimer, the term of this patent is extended or adjusted under 35 U.S.C. 154(b) by 4 days.

(21) Appl. No.: 16/247,393

(22) Filed: Jan. 14, 2019

(65) Prior Publication Data

US 2019/0218055 A1 Jul. 18, 2019

Related U.S. Application Data

(60) Provisional application No. 62/617,460, filed on Jan. 15, 2018.

(51) Int. Cl.

| | |
|---|---|
| ***B65H 54/18*** | (2006.01) |
| ***B65H 59/10*** | (2006.01) |
| ***D05B 59/02*** | (2006.01) |
| ***B65H 54/10*** | (2006.01) |
| ***B65H 54/44*** | (2006.01) |
| ***B65H 54/72*** | (2006.01) |
| ***B65H 63/08*** | (2006.01) |

(52) U.S. Cl.

CPC ..... *B65H 54/18* (2013.01); *B65H 54/106* (2013.01); *B65H 54/44* (2013.01); *B65H 54/72* (2013.01); *B65H 59/10* (2013.01); *B65H 63/082* (2013.01); *D05B 59/02* (2013.01); *B65H 2701/31* (2013.01)

(58) Field of Classification Search

CPC ..... B65H 54/106; B65H 54/18; B65H 54/44; B65H 63/082; B65H 2701/31; D05B 59/02

See application file for complete search history.

(56) References Cited

U.S. PATENT DOCUMENTS 8,567,708 B2 * 10/2013 Shimp ..... B65H 54/106 242/128

2015/0217966 A1 8/2015 Ruff

* cited by examiner

*Primary Examiner* — William E Dondero

(74) *Attorney, Agent, or Firm* — Mark David Torche; Patwrite Law

(57) ABSTRACT

A high efficiency bobbin winding device with adjustability has a housing that encloses at least one motor and associated circuitry and mechanism that allows a user to selectively wind a bobbin with a selected amount of thread. The motor is mounted on a hinged support that rotates to move the motor which has a shaft that spins the bobbin. An adjustment knob is rotated to selectively move the motor support. A sensor detects the amount of thread wound on the bobbin and stops further winding when the proper amount of thread is wound on the bobbin. The housing also has indicator lights to indicate power and other settings. A spool is placed on a rod and is thread through a guide and a tension adjustment and then on the bobbin where it is wound to a selected level.

15 Claims, 6 Drawing Sheets

HIGH EFFICIENCY BOBBIN WINDING DEVICE WITH ADJUSTABILITY

CROSS REFERENCE TO RELATED APPLICATIONS

This application claims priority and herein incorporates by reference U.S. provisional patent application 62/617,460, filed Jan. 15, 2018.

BACKGROUND OF THE INVENTION

In 2012, the global apparel market in the United States alone was valued at over a trillion dollars. The apparel market is one of the largest industries in the world and employs millions of workers.

Human history is intertwined with the history of clothing since it is uniquely human to make and wear clothes. Originally, clothing certainly was made of plants and animal skins. Later weaving was invented which greatly improved the versatility of clothing. Of course, once you have fabric, you need a way to sew it together and developments in sewing progressed along with cloth making. Bobbins were already known from weaving and they were used in sewing machines to provide a locking thread. Although bobbins are a necessary part of modern sewing machines, they need to be rewound to fill them back up when used. This can be time consuming and slow production down especially in a commercial setting. Additionally, often there is a need to change the color/type of thread being used and that also means that the thread in the bobbin must be changed as well, and you may only need a certain amount of thread loaded on a bobbin, rather than filling it completely.

There is a need for a bobbin rewinding system that is safe and easy to use that allows the user to precisely control the amount of thread wound on the bobbin.

SUMMARY OF THE INVENTION

A high efficiency bobbin winding device with adjustability has a housing that encloses at least one motor and associated circuitry and mechanism that allows a user to selectively wind a bobbin with a selected amount of thread. The motor is mounted on a hinged support that rotates to move the motor which has a shaft that spins the bobbin. An adjustment knob is rotated to selectively move the motor support. A sensor detects the amount of thread wound on the bobbin and stops further winding when the proper amount of thread is wound on the bobbin. The housing also has indicator lights to indicate power and other settings. A spool is placed on a rod and is thread through a guide and a tension adjustment and then on the bobbin where it is wound to a selected level.

Other features and advantages of the instant invention will become apparent from the following description of the invention which refers to the accompanying drawings.

DETAILED DESCRIPTION OF THE INVENTION

Figure 1:
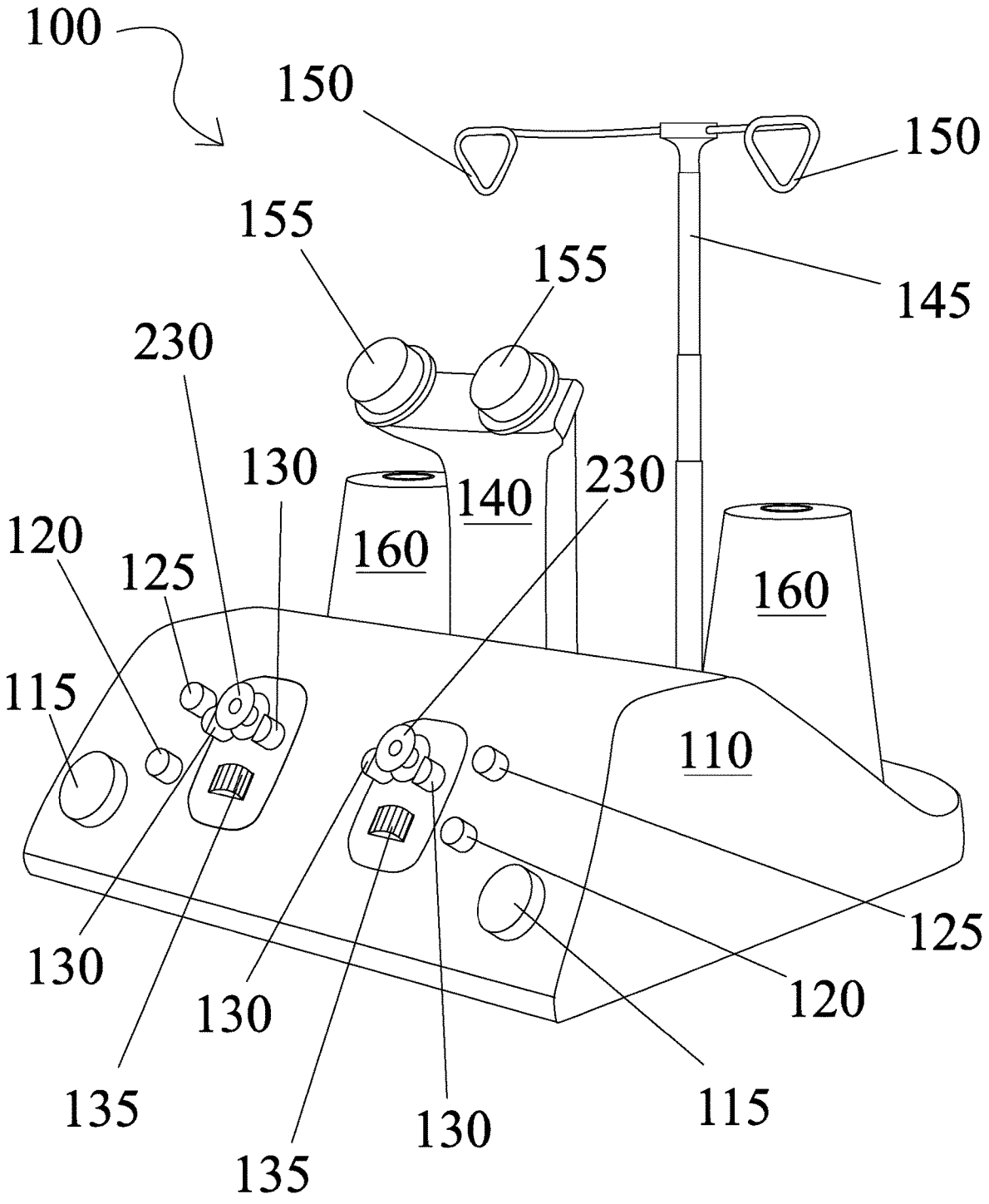
FIG. 1 is a perspective view of a high efficiency bobbin winding device with adjustability according to an embodiment of the invention.
Figure 2:
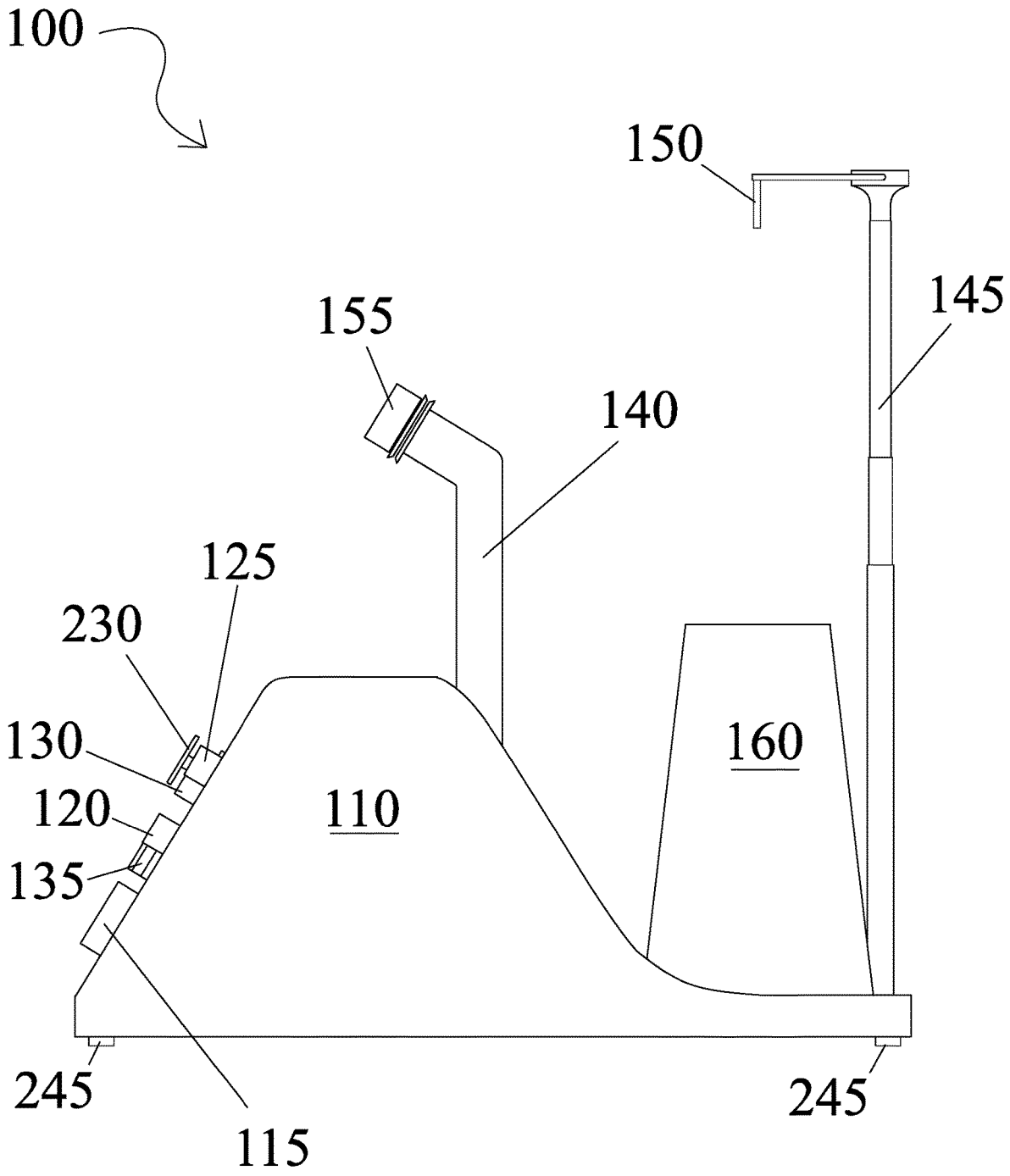
FIG. 2 is a side view of the high efficiency bobbin winding device with adjustability shown in FIG. 1.
Figure 3:
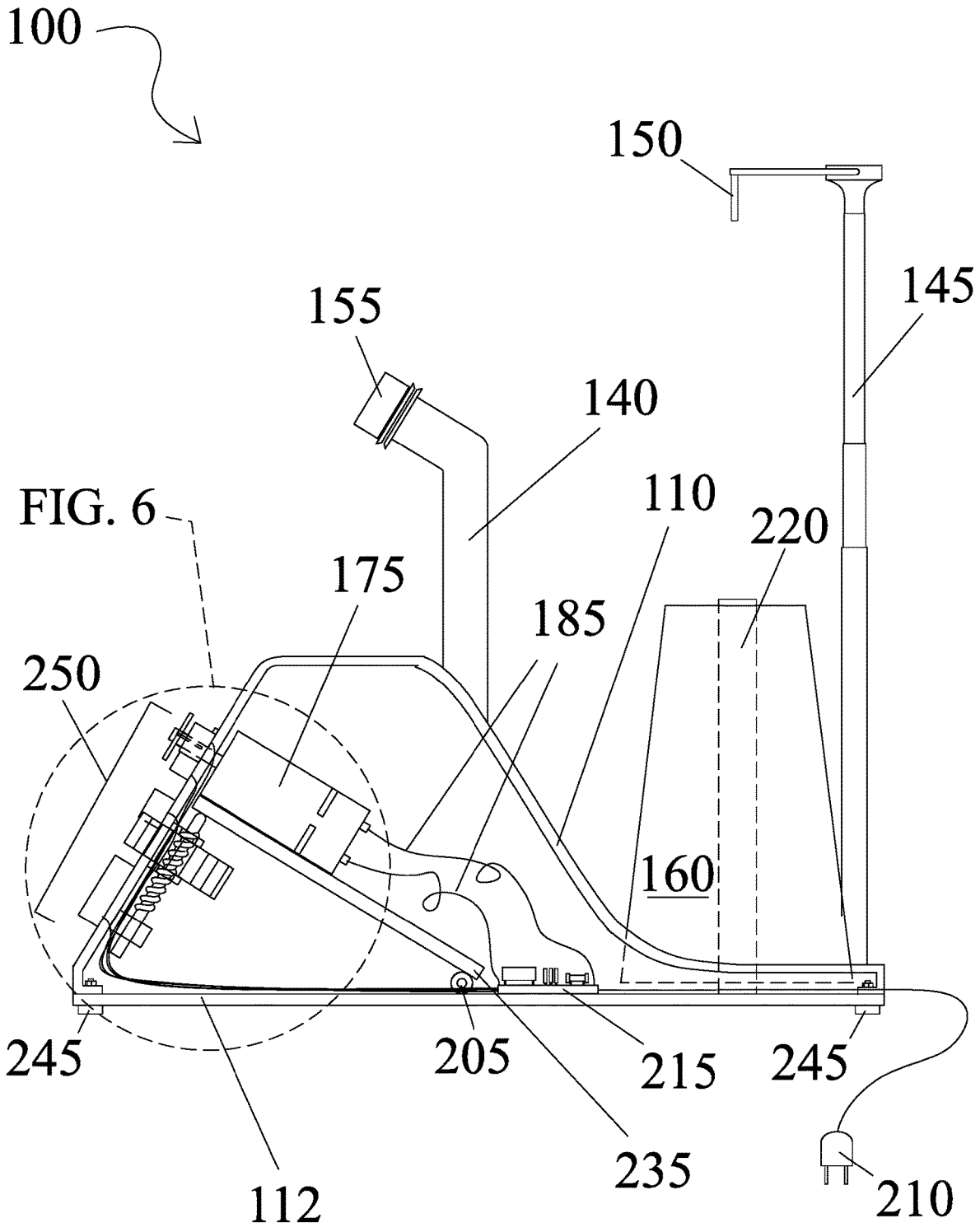
FIG. 3 is a transparent side view of the high efficiency bobbin winding device with adjustability shown in FIG. 1.
Figure 4:
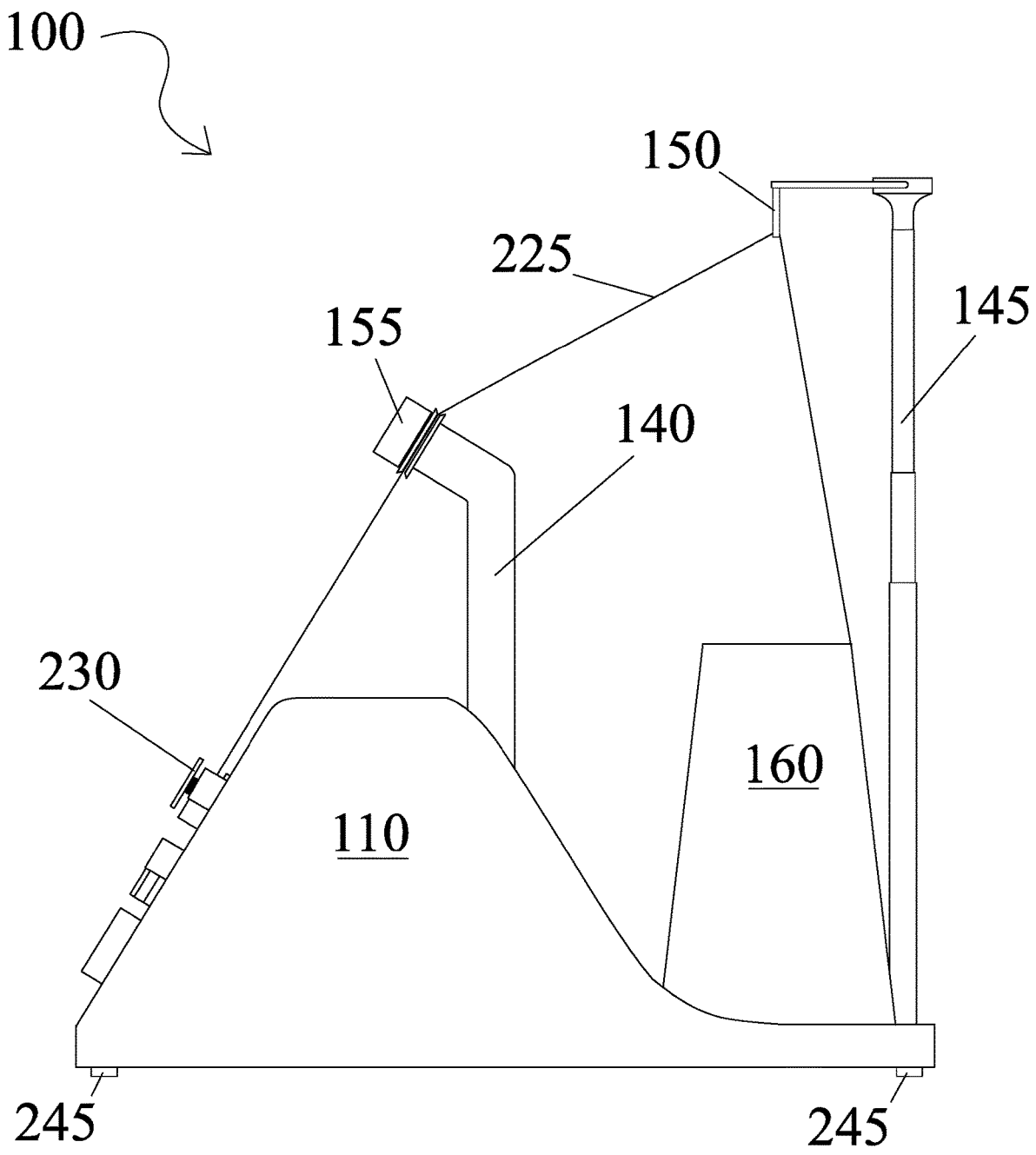
FIG. 4 is a side view of the high efficiency bobbin winding device with adjustability shown in FIG. 1 threaded.
Figure 5:
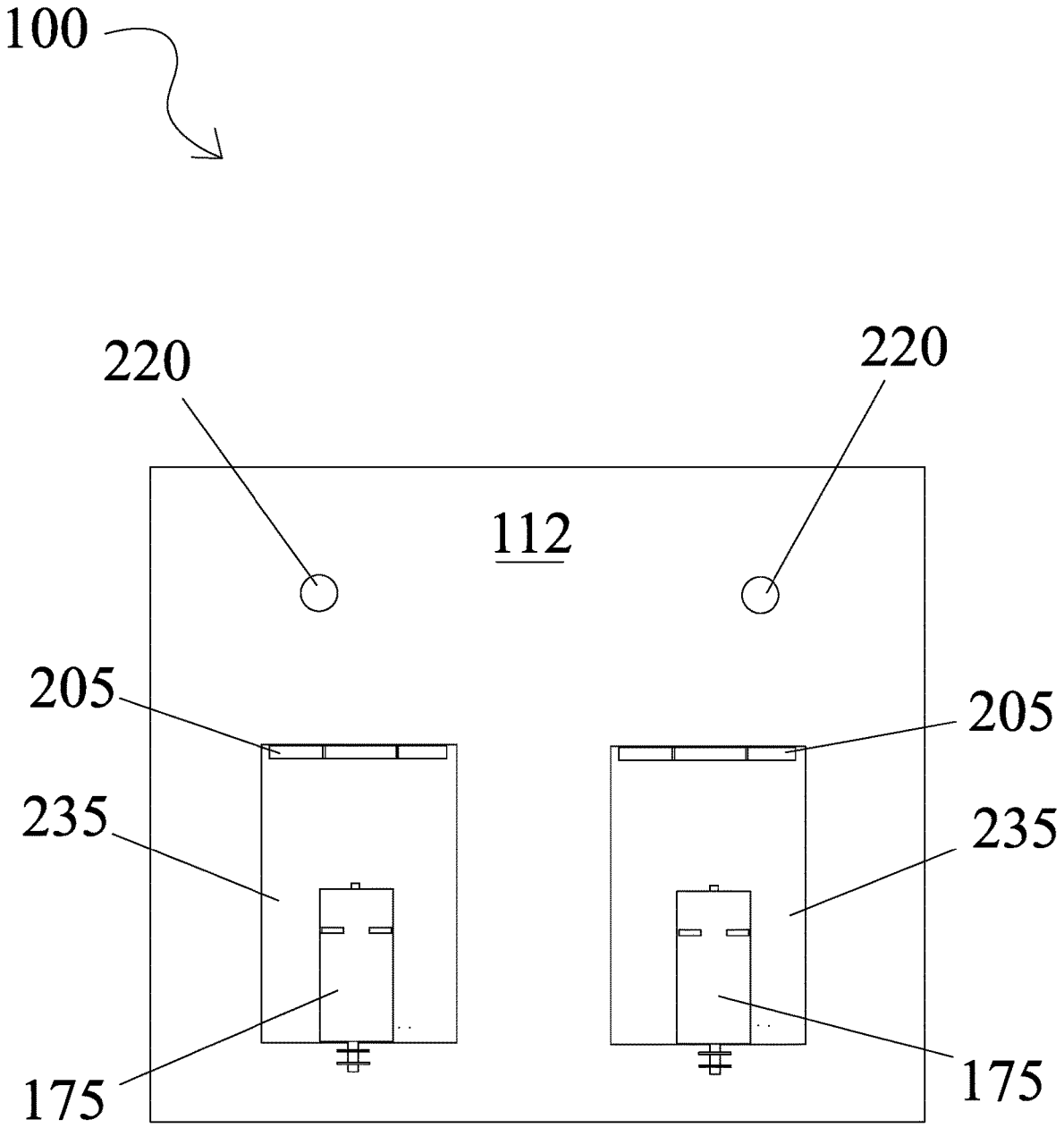
FIG. 5 is a simplified cutaway view showing the motor support.
Figure 6:
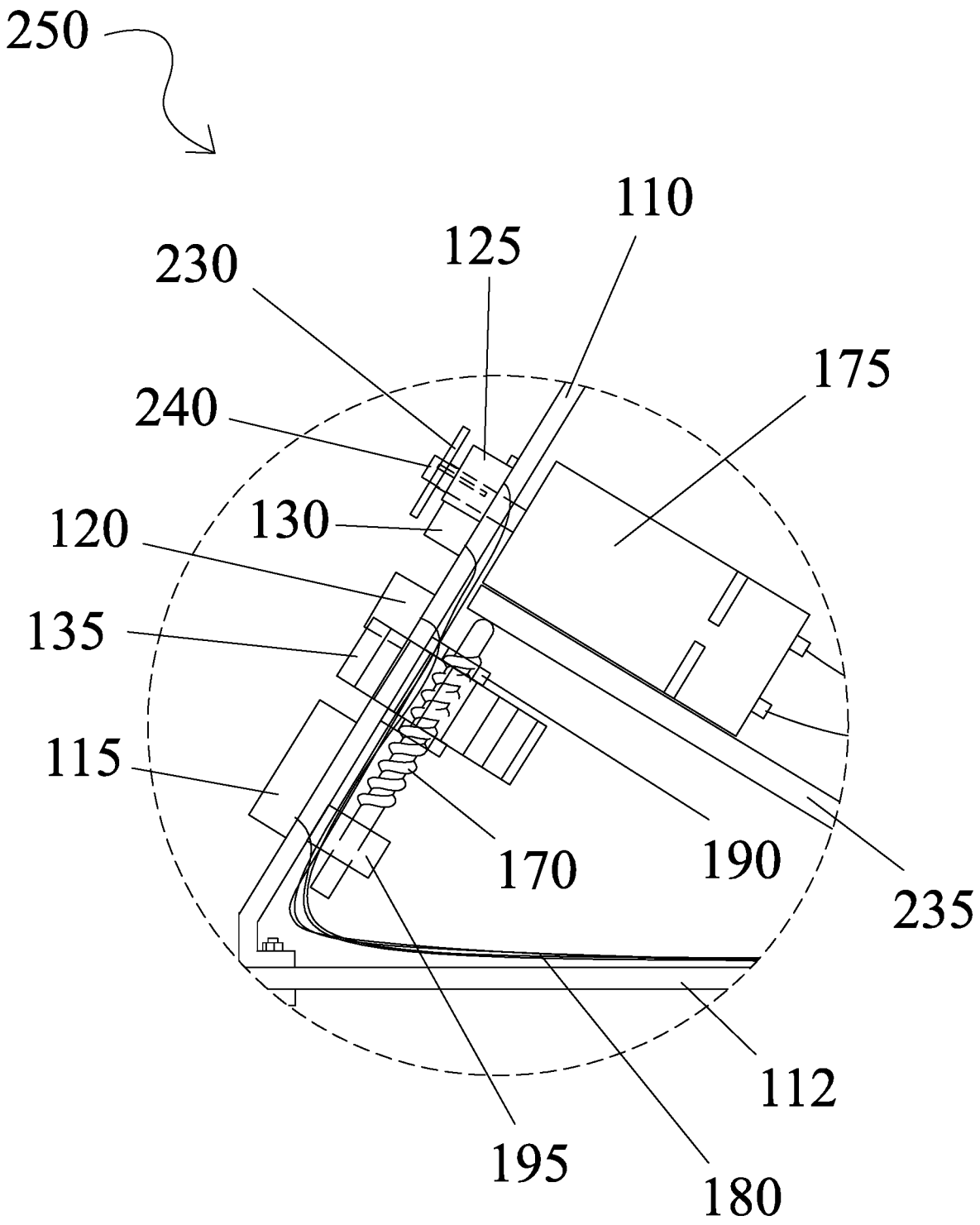
FIG. 6 is a close-up view of a portion shown in FIG. 3.

In the following detailed description of the invention, reference is made to the drawings in which reference numerals refer to like elements, and which are intended to show by way of illustration specific embodiments in which the invention may be practiced. It is understood that other embodiments may be utilized and that structural changes may be made without departing from the scope and spirit of the invention.

Referring to the figures, a high efficiency bobbin winding device with adjustability 100 is shown having a housing 110 which houses the components and electronics necessary to operate. Housing 110 is secured to a base 112 to allow components to be placed within. Slip resistant feet 245 are provided to vibrational isolation and slip resistance. In the embodiment shown, two separate and independent units are housed within housing 110. Of course, other multiples are possible by simply providing a larger housing to enclose additional units.

The discussion below will describe a motor assembly 250 with the understanding that the other unit (or units) is exactly the same and would apply to any number of units. Power switch 115 is provided to allow a user to turn the high efficiency bobbin winding device with adjustability 100 on and off. Additionally, power switch 115 may be illuminated when energized to allow the user to visually ascertain the power status. Various indicators are provided to help make use intuitive and safe. A ready indicator 120 is provided to let the user know that a bobbin 230 is loaded and ready to be wound. An indicator light 125 is provided to visually inform the user that bobbin 230 is wound to a selected fill level.

A shutoff sensor 130 is provided to electronically control a motor 175 to stop rewinding when bobbin 230 reaches the selected fill level. An adjustment knob 135 is provided to allow the user to select exactly how full to wind bobbin 230. A spool of thread 160 is placed on a spool rod 220 and thread 225 is threaded through a guide loop 150 which is mounted to a guide tree 145 and then is threaded through a tension adjustment 155 and then to bobbin 230 wherein thread 225 is wound thereon. Guide tree 145 is telescopic to allow the user to adjust the height to accommodate different spools of thread 160. Tension adjustment 155 is mounted on a tension mast 140 to properly position it.

Motor 175 is mounted on a hinged motor support 235 which is attached to a hinge 205 which is mounted to base 112. Motor 175 rotates around hinge 205 which moves bobbin 230 to a selected position which is detected by sensor 130. Sensor 130 utilizes light source and receiver to detect the selected fill level as is known in the art. The light source may be LASER, LED or other suitable light source as is known in the art. A worm gear 170 is rotated using an adjustment knob 135 which is rotationally supported by a pair of adjustment knob supports 190.

Of course other support means may be used as long as adjustment knob 135 is free to move and to rotate and move worm gear 170 up and down which in turn moves motor support 235 in an arc about hinge 205. Bobbin 230 is placed on a motor shaft 240 which is rotates to wind thread 225 on bobbin 230. A worm gear support 195 is used to support and guide worm gear 170 as it is rotated. Of course, other means besides worm gears may be used such as, but not limited to, servo motors, lever, eccentric mechanism or other suitable method to move motor 175 in order to adjust the fill level of bobbin 230.

An electronic control 215 is provided to control the speed and other functions of motor 175 and indicator lights. Motor 175 is electrically connected to electronic control 215 using wires 185. A plug 210 is provided to allow the user to plug high efficiency bobbin winding device with adjustability 100 into an electrical source. Electric control 215 is also electrically connected to shutoff sensor 130 and other indicator lights, 115, 120 and power switch 115 using wiring 180. Electronic control 215 may include a microprocessor to control the speed of motor 175. The microprocessor may be factory programmed or may be user programmed as is known in the art to allow for more flexibility in various situations and operating conditions.

Although the instant invention has been described in relation to particular embodiments thereof, many other variations and modifications and other uses will become apparent to those skilled in the art.

What is claimed is:

1. A high efficiency bobbin winding device with adjustability comprising:

a housing;

a base;

said housing being disposed on said base;

at least one motor assembly comprising;

a hinged motor support rotably secured at a lower end to said base;

a motor secured to said hinged motor support;

a motor shaft adapted to releasably hold a bobbin;

a shutoff sensor disposed on a front portion of said housing whereby a selected fill level of said bobbin is detected;

an electronic control electrically connected to said at least one motor and said shutoff sensor; and and adjustment means for selectively adjusting a position of said motor to said selected fill level.

2. The high efficiency bobbin winding device with adjustability according to claim 1 wherein said adjustment means comprises:

a worm gear moveably disposed on an inside front edge of said housing; and said hinged motor support being supported at an opposite end by a top of said worm gear whereby an angle of said hinged motor support is adjustable by rotating said worm gear and whereby said angle determines said fill level.

3. The high efficiency bobbin winding device with adjustability according to claim 1 further comprising:

at least one spool rod mounted on a rearward portion of said housing whereby a spool of thread is rotatably and removably disposed thereon;

at least one guide tree adjacently mounted to said at least one spool rod; and a guide loop disposed on a top portion of said guide tree whereby a thread from said spool of thread is guided towards said bobbin.

4. The high efficiency bobbin winding device with adjustability according to claim 3 further comprising;

a tension mast disposed on a top portion of said housing and between said guide loop and said bobbin; and a tension adjustment attached to a top portion of said tension mast whereby the tension of said thread is controlled.

5. The high efficiency bobbin winding device with adjustability according to claim 3 where said at least one guide tree is telescopically adjustable.

6. The high efficiency bobbin winding device with adjustability according to claim 1 where said shutoff sensor is a light sensor.

7. The high efficiency bobbin winding device with adjustability according to claim 1 further comprising a power on switch electrically connected to said electric control.

8. The high efficiency bobbin winding device with adjustability according to claim 7 whereby said power on switch is illuminated.

9. The high efficiency bobbin winding device with adjustability according to claim 1 further comprising a ready indicator light whereby a user is visually notified that the winding operation is ready to proceed.

10. The high efficiency bobbin winding device with adjustability according to claim 9 further comprising a done indicator light whereby said notified that said bobbin is full.

11. The high efficiency bobbin winding device with adjustability according to claim 1 wherein said electronic control is electrically connected to an alternating current power source.

12. The high efficiency bobbin winding device with adjustability according to claim 1 whereby said electric control controls a speed of said motor.

13. The high efficiency bobbin winding device with adjustability according to claim 1 whereby said electronic controller includes a microprocessor to control a speed of said motor.

14. The high efficiency bobbin winding device with adjustability according to claim 1 further comprising feet disposed on an underside of said base.

15. The high efficiency bobbin winding device with adjustability according to claim 1 whereby said motor is turned off when said selected fill level is reached.

* * * * *